US008347977B2

(12) United States Patent
Hendron et al.

(10) Patent No.: US 8,347,977 B2
(45) Date of Patent: Jan. 8, 2013

(54) POWERED MOBILE MODULE AND ATTACHMENT COMBINATION

(75) Inventors: Scott Svend Hendron, Dubuque, IA (US); Scott Bender, Des Moines, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 13/416,434

(22) Filed: Mar. 9, 2012

(65) Prior Publication Data

US 2012/0186840 A1 Jul. 26, 2012

Related U.S. Application Data

(62) Division of application No. 12/652,994, filed on Jan. 6, 2010, now Pat. No. 8,167,053.

(51) Int. Cl.
*E02F 3/76* (2006.01)

(52) U.S. Cl. ..... 172/814; 180/14.2

(58) Field of Classification Search ..... 172/810, 172/811, 814, 292; 212/180; 37/394; 280/413; 180/14.1, 14.2; 56/6
See application file for complete search history.

(56) References Cited

U.S. PATENT DOCUMENTS

| | | | | | |
|---|---|---|---|---|---|
| 1,310,604 | A * | 7/1919 | Burgess | 180/14.1 |
| 3,280,931 | A * | 10/1966 | Cahill et al. | 180/23 |
| 3,552,497 | A * | 1/1971 | Stedman | 172/292 |
| 3,572,444 | A * | 3/1971 | Scholl et al. | 172/4.5 |
| 3,601,210 | A * | 8/1971 | Stedman et al. | 180/6.7 |
| 3,661,214 | A * | 5/1972 | Peterson et al. | 172/814 |
| 4,053,021 | A * | 10/1977 | Sturges et al. | 172/814 |
| 4,085,813 | A * | 4/1978 | Joubert | 180/14.2 |
| 4,086,975 | A * | 5/1978 | Nystuen | 180/14.2 |
| 4,096,961 | A * | 6/1978 | Rocco | 414/642 |
| 4,171,023 | A * | 10/1979 | Sturges | 172/814 |
| 5,403,144 | A * | 4/1995 | Staben, Jr. | 414/697 |
| 6,360,459 | B1 * | 3/2002 | Brookhart et al. | 37/442 |
| 6,564,955 | B2 * | 5/2003 | Franzen et al. | 212/301 |
| 7,946,372 | B2 * | 5/2011 | Shraga et al. | 180/197 |

* cited by examiner

*Primary Examiner* — Jamie L McGowan

(57) ABSTRACT

Various attachments (different dozer blade arrangements, a gantry crane, large auger) are designed for use with multiple identical powered mobile modules including a main support frame housing an internal combustion engine as a prime mover and being supported on either powered tracks or wheels. The modules can be either equipped with a cab and manned or used without a cab and controlled remotely. One or more of the mobile modules may be equipped with a GPS unit to aid in positioning the associated attachment.

3 Claims, 7 Drawing Sheets

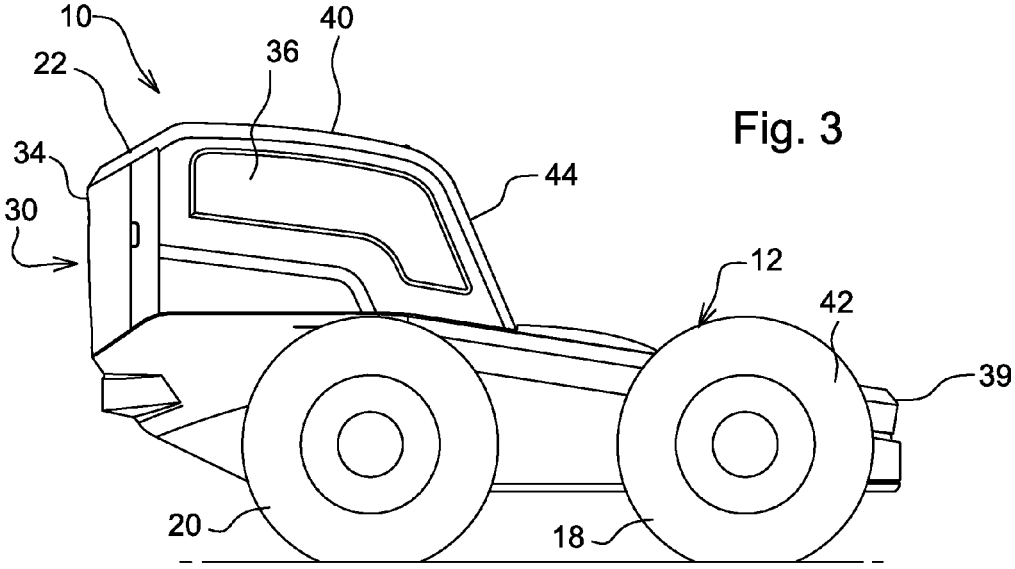
Fig. 3
Fig. 4
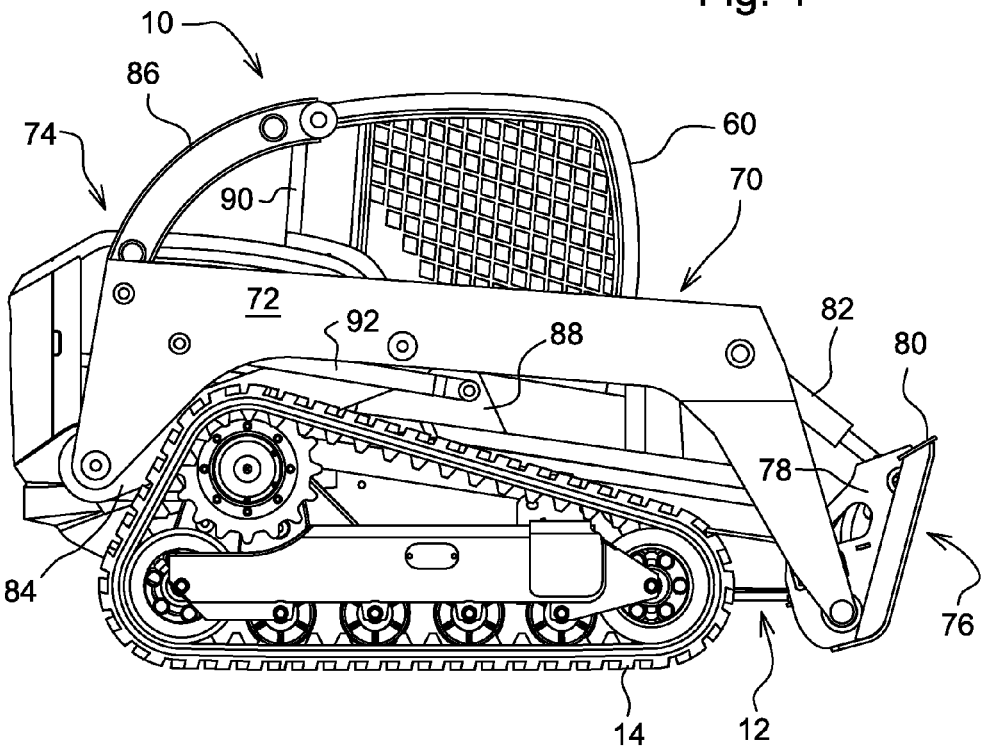

POWERED MOBILE MODULE AND ATTACHMENT COMBINATION

CROSS-REFERENCE TO RELATED APPLICATION his application is a divisional of U.S. application Ser. No. 12/652,994, filed Jan. 6, 2010 now U.S. Pat. No. 8,167,053.

FIELD OF THE INVENTION

The present invention relates to powered mobile machinery, and, more specifically, relates to powered mobile modules that are capable for selectively powering a variety of attachments rather than being dedicated for performing a single task.

BACKGROUND OF THE INVENTION

There are a multitude of powered tool and powered equipment designs wherein a base component is used to which a variety of attachments can be selectively connected. One common example of such powered tools is the use of a battery pack to which a number of so called "cordless" electrically driven tools (drills, saws, sanders, etc.) may be alternately coupled for receiving driving power from the battery pack. The utility work machines manufactured by the Bobcat Company are an example of powered equipment, which utilize a base component including a powered wheel-supported main frame, and are advertised as being adapted for being selectively coupled to forty easy-to-change attachments.

However, there is a need for being able to provide additional power for operating some attachments without increasing the size of the powered mobile module.

SUMMARY OF THE INVENTION

According to the present invention there is provided a novel powered mobile module and attachment combination which makes it possible for providing an increase in the amount of power available for operating a given attachment by using a non-dedicated powered mobile module without increasing the size of the powered module.

An object of the invention is to provide a powered mobile module and attachment combination wherein the attachment is configured for being coupled to a plurality of identical powered mobile modules.

In a first embodiment, the attachment is in the form of a dozer blade having first and second mounting brackets respectively secured to opposite end locations of the backside of the dozer blade, with main support frames of first and second powered mobile modules being respectively connected to the first and second mounting brackets.

A second embodiment is provided which utilizes two powered mobile modules like the first embodiment, but instead of having two connection assemblies on the backside of the dozer blade, only a single connection assembly is provided and it is located midway between opposite ends of the blade while the second is provided in fore-and-aft alignment with the first connection assembly at a backside of a cross beam secured to rear ends of a pair of side beams having forward ends secured to the backside of the blade at locations adjacent opposite ends of the blade.

A third embodiment is provided which is like the first embodiment but additionally includes a fore-and-aft extending beam having a forward end fixed to a central location of the backside of the dozer blade, and having a rear end to which a third connection assembly is secured, with the main frame of a third powered mobile module having a forward end connected to the third connection assembly.

A fourth embodiment is provided, wherein the attachment is also a dozer blade, but, in this case two connection assemblies are secured to transversely spaced locations at opposite sides of a middle location on the backside of the dozer blade, and a framework is secured to the backside of the blade so as to form an enclosed rectangular zone behind each of the two adaptors, with a backside of the framework supporting two more connection assemblies respectively in fore-and-aft alignment with the first two connection assemblies, whereby four separate powered, mobile base components may respectively be secured to the four connection assemblies.

In a fourth embodiment, the attachment is in the form of a gantry crane including a transverse guide beam having opposite ends respectively fixed to the main frames of a pair of powered, mobile modules by respective vertical mounting plates. An object handling apparatus is mounted for traveling along said transverse guide beam.

In a fifth embodiment, the attachment is in the form of a large auger including an elevated support beam having a middle location connected in supporting relationship to a vertical auger. Opposite ends of the support beam are respectively coupled to the frames of first and second powered mobile modules, with the modules facing in opposite directions so that by driving them both in a forward direction about a circular path they effect rotation of the auger.

The powered mobile modules used in all of the foregoing embodiments are constructed in a skid-steer form having either tracks or tires, and can be used in either a manned mode, in which case a cab is mounted to the module, or an unmanned mode, wherein no cab is required but the control system must be placed in a robotic or autonomous mode, with control signals being sent from a remote location or from a manned module.

The foregoing and other objects will be apparent from a reading of the ensuing description together with the appended drawings.

BRIEF DESCRIPTION OF THE DRAWINGS

FIG. 3 is a view like that of FIG. 2, but showing the module equipped with tires instead of tracks.

FIG. 4 is a side view like that of FIG. 2 with the module being equipped with a cab and with a lift boom arrangement carrying an attachment mounting apparatus at its forward end.

DESCRIPTION OF THE PREFERRED EMBODIMENT

Before any embodiments of the invention are explained in detail, it is to be understood that the invention is not limited in its application to the details of construction and the arrangement of components set forth in the following description or illustrated in the following drawings. The invention is capable of being carried out in various ways. Also, it is to be understood that the phraseology and terminology used herein is for the purpose of description and should not be regarded as limiting. The use of "including", "comprising" or "having" and variations thereof herein is meant to encompass the items listed thereafter and equivalents thereof as well as additional items. Unless specified or limited otherwise, the terms "mounted", "connected", "supported" and "coupled" and variations thereof are used broadly and encompass both direct and indirect mountings, connections, supports and couplings.

As should also be apparent to one of ordinary skill in the art, although no specific systems are shown in the figures, there are various systems available in the prior art which are suitable for use with the disclosed vehicles and implements. Remote control of unmanned modules is capable of being implemented in software executed by a microprocessor or a similar device, or of being implemented in hardware using a variety of components including, for example, application specific integrated circuits ("ASICS"). Terms like "processor" and "controller" may include or refer to hardware and/or software. While a control-area network (CAN) bus is mentioned as an example of a communication network in the following embodiments, these embodiments can also utilize other networks, such as a wireless network. Thus, the claims should not be limited to specific examples or terminology or to any specific hardware or software implementation or combination of software or hardware.

Furthermore, although the illustrated embodiment contemplates application of the invention to skid steer machines, the invention may be applied to other power machines.

Figure 1:
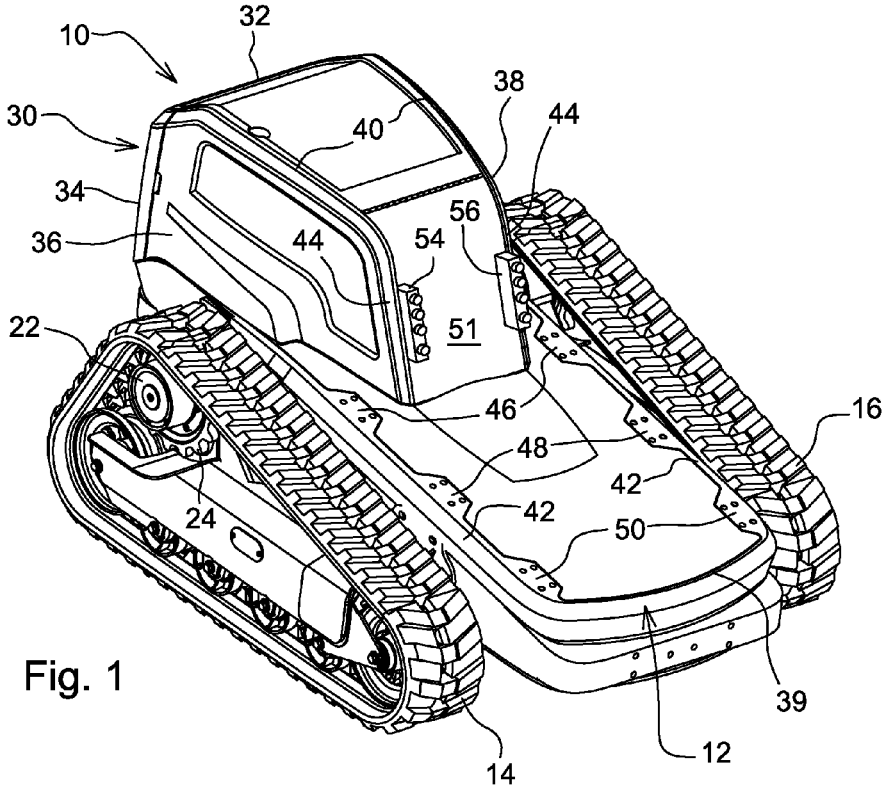
FIG. 1 is a right front perspective view looking downward at a powered mobile module having tracks and being constructed in accordance with the principles of the present invention.
Figure 2:
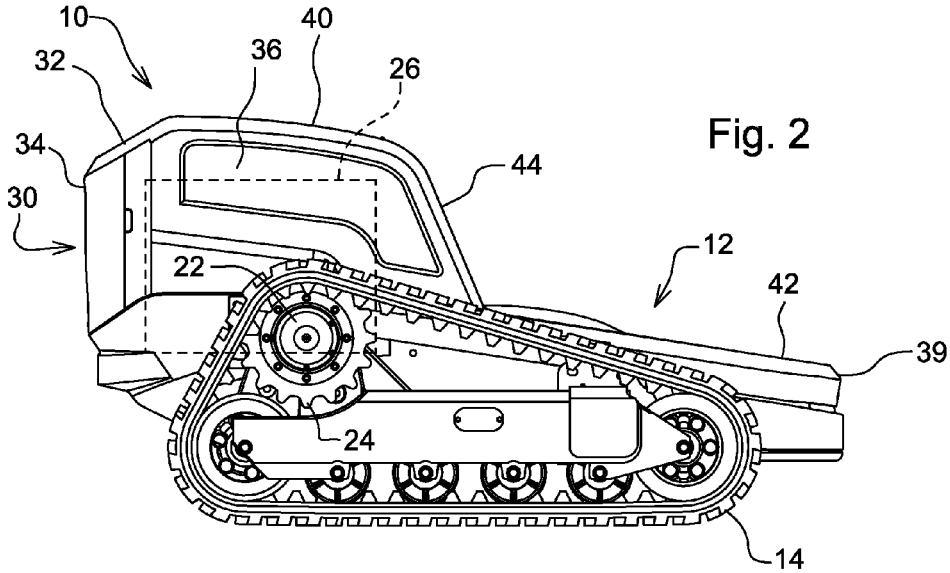
FIG. 2 is right side view of the module shown in FIG. 1.

Referring now to FIGS. 1 and 2, there is shown a powered mobile module 10 for forming a base part of a skid steer vehicle. The module 10 includes a generally shoe-shaped main support frame 12 mounted on right and left endless tracks 14 and 16, respectively, or on right and left pairs of front and rear wheels 18 and 20, respectively, as shown in FIG. 3. The tracks 14 and 16, or pairs of wheels 18 and 20 are conventionally driven by hydraulic motors (one motor 22 being shown in FIGS. 1 and 2 coupled to a track drive sprocket 24 for driving the right track 14) incorporated in a hydraulic system powered by an internal combustion engine 26, shown schematically in FIG. 2, that is located in an engine compartment 30 provided in a rear region of the frame 12. The engine compartment 30 is defined by a curved wall arrangement connected to the frame 12 rearward of the engine 26, the compartment 30 containing an oil cooler, radiator and fan (not shown), with the engine being coupled for driving the fan for drawing cooling air in through louvers 32 at the top rear of compartment and a screen 34 at the rear of the compartment 30.

The frame 12 includes transversely spaced, fore-and-aft extending, right and left vertical side walls 36 and 38, respectively, having forward ends joined by an upright front wall 39, The side walls 36 and 38 each have an upper edge which includes an elevated, generally horizontal upper rear section 40 joined to a generally horizontal lower front section 42 by a downwardly and forwardly angled section 44. Right and left pairs of horizontal support pads 46 are joined to, and extend inwardly towards each other from rear regions of the lower front edge sections 42, while similar pairs of support pads 48 and 50, respectively, are joined to middle and front regions of the edge sections 42. A support plate 52, shaped similarly in side view to the upper edges of the side walls 36 and 38, extends between and is supported by the side walls 36 and 38, with the plate 52 containing right and left coupling arrangements 54 and 56, respectively, adapted for being coupled to controls (not shown) for controlling operation of various components associated with the module 10 including the engine 26 and drive train for the tracks 14 and 16.

Referring now to FIG. 4, it can be seen that an operator's cab 60 is mounted on the module 10. The cab 60 would normally contain a seat and controls (not shown) operable by a seated operator for controlling operation of the engine, tracks and attached implements. Controls particularly suitable for use in the present invention would be electro-hydraulic controls which are coupled for sending signals to various proportional control valves for effecting operation of right and left hydraulic drive motors for the propulsion tracks 14 and 16, or right and left sets of wheels 18 and 20 for selectively causing straight ahead, right or left turning or reverse operations. Electrical signals would be proportional to the amount of movement manually imparted to lever controls including joystick controls, for example. It is further noted that the module 10 would be equipped with an on-board computer and a remote control unit permitting the module 10 to remotely control another module or to be controlled remotely by another module. For this purpose, each remote control unit would be provided with an aerial for transmitting a radio signal to a receiver forming part of an electro-hydraulic control system of the module. Such an arrangement is disclosed in U.S. Pat. No. 6,283,220, granted to Carter on Sep. 4, 2001.

Mounted to the module 10 is a lift boom arrangement 70 including boom arms 72 positioned on each side of the module 10 by way of a linkage arrangement 74. A mounting adapter 76 extends transversely across the front ends of the arms 72 and includes a pair of upright holders 78 each defined by a pair of parallel, transversely spaced plates between which the arms 72 are respectively received, with a pivotal connection being made between lower regions of the holders 78 and the arms 72. The mounting adapter 76 further includes a horizontal elongate bar 80 which extends between and is joined to upper forward regions of the holders 78, and a tilt cylinder 82 is coupled between each boom arm 72 and holder 78 for selectively tilting the mounting adapter 76 about its pivotal mounting with the arms 72. The boom arms 72 and the linkage arrangement 74 are generally identical on both the left and right sides of the module 10. Therefore, only the structure on the right side of the module 10 will be described in detail below.

The linkage arrangement 74 is designed so that the mounting adapter 76 will describe a near vertical path of movement within a lower portion of a normal operating range of vertical movement of the boom arms 72, the significance of this near vertical movement having an apparent advantage when used in conjunction with some of the attachments described below. Specifically, the linkage arrangement 74 includes bottom and top link members 84 and 86. The bottom link member 84 has a forward end coupled to a bracket 88 fixed to a middle portion of the right side wall 36 of the module 10, and has a rear end connected to a lower rear end location of right boom arm 72. The top link member 86 has a front end pivotally coupled to an upper end of a right vertical support post 90 having a bottom end fixed to the right frame side wall 36 just to the rear of the cab 60. A rear end of the link member 86 is pivotally coupled to an upper rear region of the right boom arm 72. An extensible and retractable hydraulic actuator 92 is coupled between the bracket 88 and a rear region of the right boom arm 72, the arm 72 being lowered when the actuator is retracted, a shown in FIG. 4, and raised when the actuator is extended.

Figure 5:
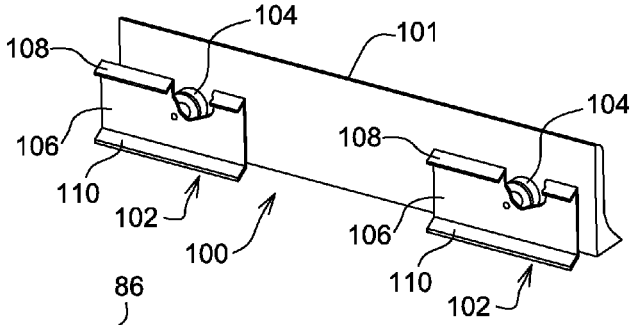
FIG. 5 is a right rear perspective view showing a first dozer blade embodiment to which a pair of powered modules equipped with a lift boom arrangement and attachment mounting apparatus like that shown in FIG. 4 may be attached in side-by-side relationship to each other.

Referring now to FIG. 5, there is shown an attachment in the form of a first dozer blade arrangement 100 wherein an elongate blade 101 forms its own carrying frame and has a rear side having opposite end regions respectively to which a pair of brackets 102 are each attached through the agency of a ball joint assembly 104. The brackets 102 are constructed as a formed plate having a vertical rectangular central portion 106 having a horizontal top edge joined to a downwardly and rearwardly inclined top flange 108, which together with the vertical portion defines a downwardly opening receptacle having an inverted V shape in side view. The central portion 106 of each bracket 102 has a horizontal bottom edge which is joined to a bottom flange 110, the latter containing at least one vertical opening (not shown) for receiving a locking element (not shown) carried by the mounting adapter 76. Although the components could be reversed, it is noted that the ball joint assembly 104 is arranged with the ball fixed to, and projecting forwardly from a central location of the central portion 106 of each of the brackets 102, with a corresponding ball receptacle being fixed to the back side of the dozer blade 101.

Figure 6:
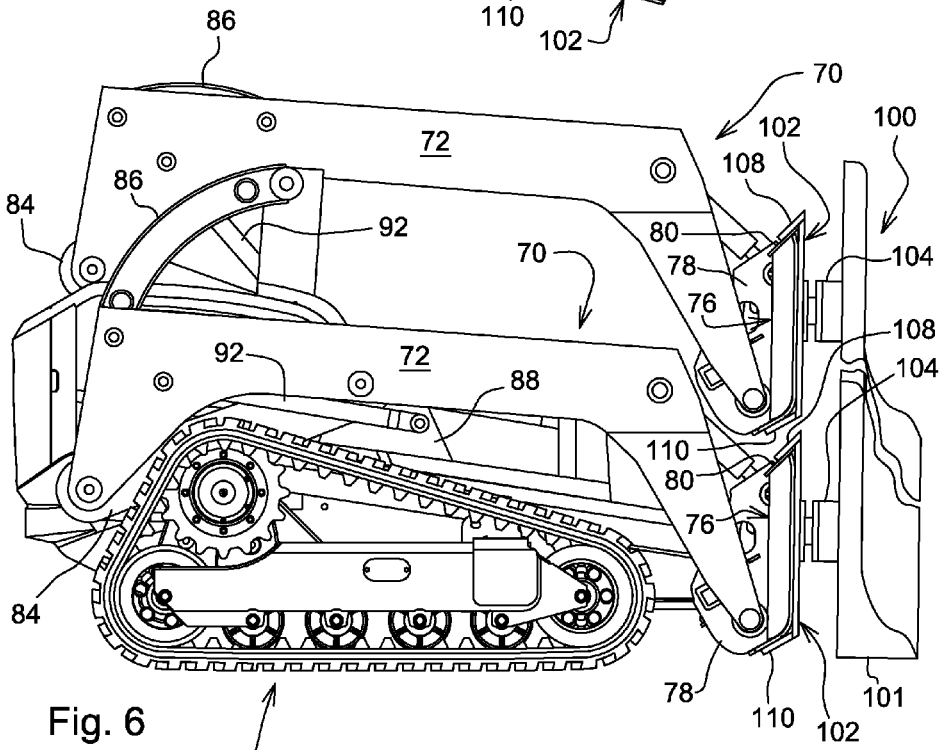
FIG. 6 is a schematic left side view of the dozer blade shown in FIG. 5 together with two powered mobile modules connected to the dozer blade, with the boom arms of the right module being lowered and the boom arms of the left module being raised such that the blade is tilted with its left end elevated above its right end.

Referring now to the schematic view illustrated in FIG. 6 of the dozer blade 101 mounted to the boom arms 72 of first and second mobile powered modules 10, it can be seen that the boom arms 72 are respectively coupled to the pair of brackets 102 provided at the back side of the dozer blade arrangement 100, with the respective elongate bars 80 of the adapters 76 being received within an associated one of the V-shaped receptacles defined by the top flanges 108 of the brackets 102. The bottoms of the adapters 76 are located above the bottom flange 110 and is secured thereto by the locking element carried by the adapter 76. As illustrated, the boom arms 72 of the right module 10 are in a lowered position wherein the right end of the blade 101 is resting on the ground, while the boom arms 72 of the left module 10 are raised a small amount thereby elevating the left end of the blade 100 above the right end of the blade. It will be appreciated that this tilting movement of the blade 100 is facilitated by the ball joint assemblies 104. The blade 101 may be pitched forwardly by operation of the tilt cylinders 86 so as to pivot the adapters 76 forwardly about their connections with the boom arms 72.

Figure 7:
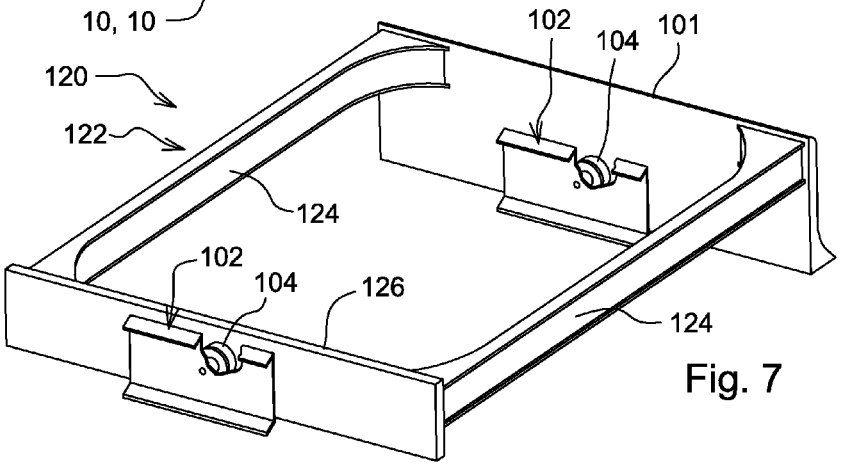
FIG. 7 is a right rear perspective view showing a second dozer blade embodiment to which a pair of powered modules equipped like that shown in FIG. 4 may be attached in fore-and-aft alignment with each other.

Referring now to FIG. 7, there is shown a second dozer blade arrangement 120 including a rectangular frame 122 having its forward end defined by the blade 101, opposite, transversely spaced sides defined by fore-and-aft extending side beams 124 having their forward ends joined to opposite end locations of the backside of the dozer blade 101 and their rear ends joined to a cross beam 126. Front and rear mounting brackets 102 are respectively fixed to centered locations between opposite ends of the blade 101 and between opposite ends of the cross beam 126, with each of these brackets being fixed through the agency of a ball joint assembly 104.

Figure 8:
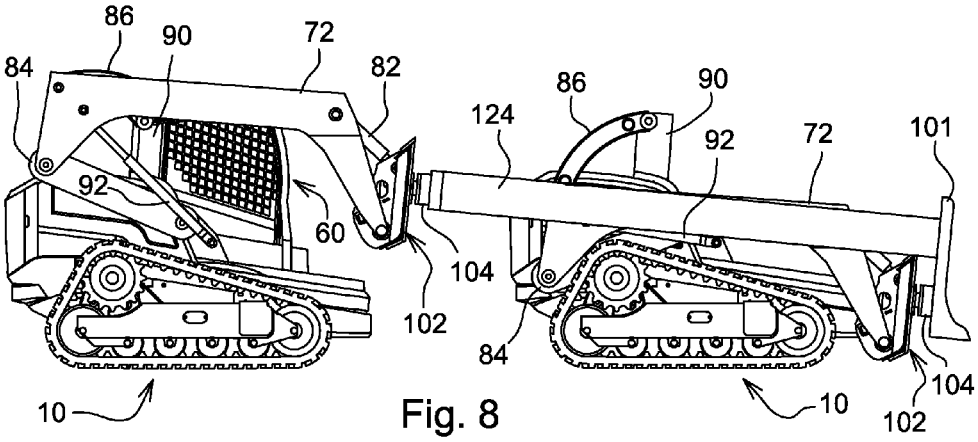
FIG. 8 is a schematic right side view showing the dozer blade of FIG. 7 attached to the front of boom arrangement provided on each of a pair of powered modules, with the dozer blade being shown in a position wherein it is lowered onto the ground in front of the front powered module and pitched forward.
Figure 9:
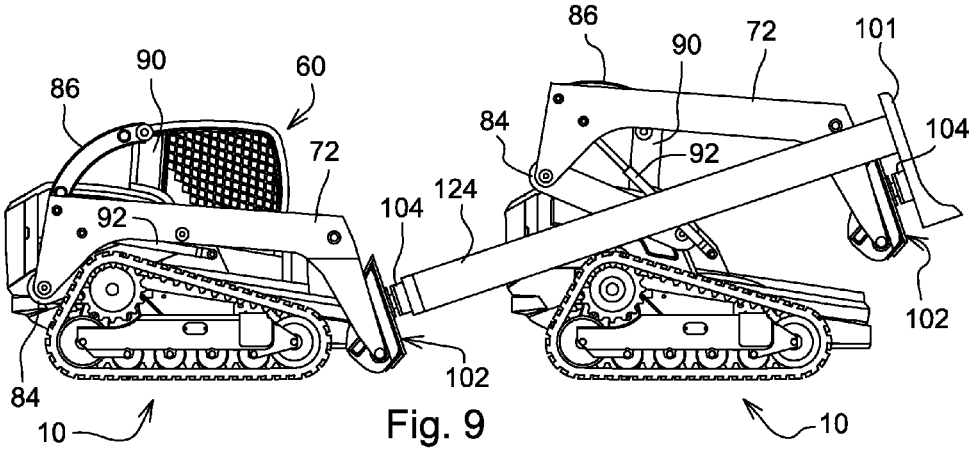
FIG. 9 is a view like that of FIG. 8, but showing the blade in a raised, rearwardly pitched position.
Figure 10:
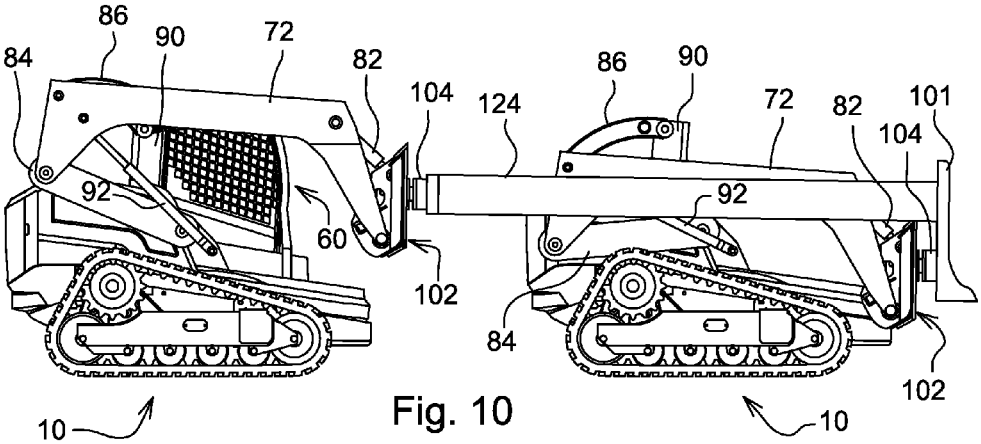
FIG. 10 is view like that of FIG. 7, but showing the blade in a raised, level position.

Referring to FIG. 8, there is shown a schematic side view of a pair of powered modules 10 carrying boom arms 72 equipped with adapters 76 that are connected to the brackets 102. The front module 10 is here shown with its associated boom arms 72 in a lowered position, while the arms 72 of the rear module 10 are raised to a considerable height resulting in the blade 101 being located on the ground and pitched forwardly. FIG. 9 is a view similar to that of FIG. 8, but here the boom arms 72 of the rear module 10 are lowered while the boom arms 72 of the front module 10 are raised. This results in the blade 101 being raised and pitched back. FIG. 10 is a view similar to that of FIG. 8, but here the boom arms 72 of both the front and rear modules 10 are raised an equal amount resulting in the blade 101 being raised and disposed in a level, non-tilted position.

Figure 11:
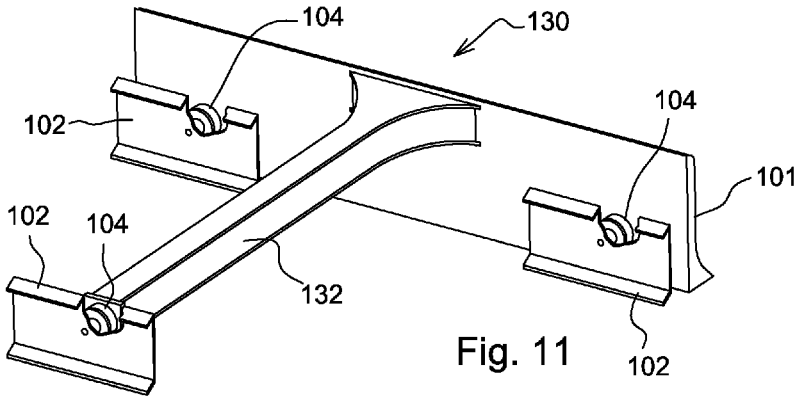
FIG. 11 is a right rear perspective view of a third dozer blade embodiment to which a side-by-side pair of powered mobile modules may be connected along with a third powered module located equidistant from, and behind the side-by-side pair.

A third dozer blade arrangement 130 is shown in FIG. 11 wherein the blade 101 has right and left bracket assemblies 102 respectively coupled to locations adjacent right and left ends of the blade 101 by the agency of right and left ball joint assemblies 104. A third bracket assembly 102 is similarly connected to a rear end of a central beam 132 having its forward end secured to a central location of the backside of the blade 101 equidistant from the right and left bracket assemblies 102. It is noted that blade pitching operations can be accomplished in a manner similar to that described above with reference to FIGS. 8, 9 and 10.

Figure 12:
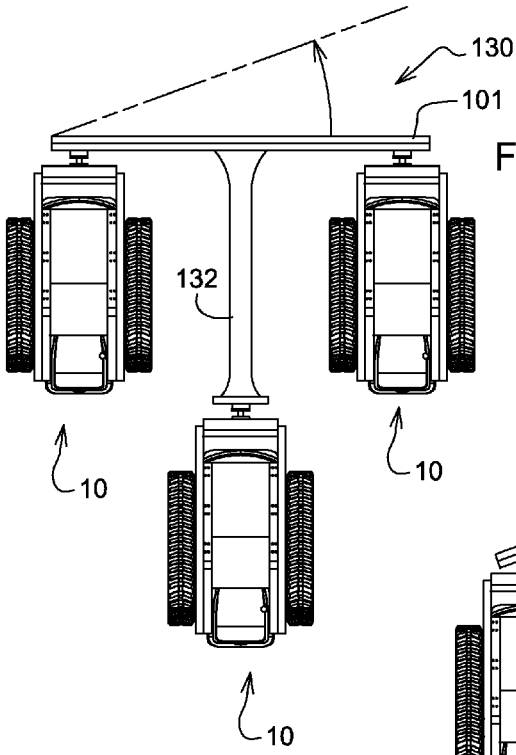
FIG. 12 is a schematic top view of the blade shown in FIG. 11 being connected to the forward ends of boom arrangements respectively mounted to the three powered mobile modules, with the blade being shown in a position perpendicular to a common direction of travel of the mobile modules.
Figure 13:
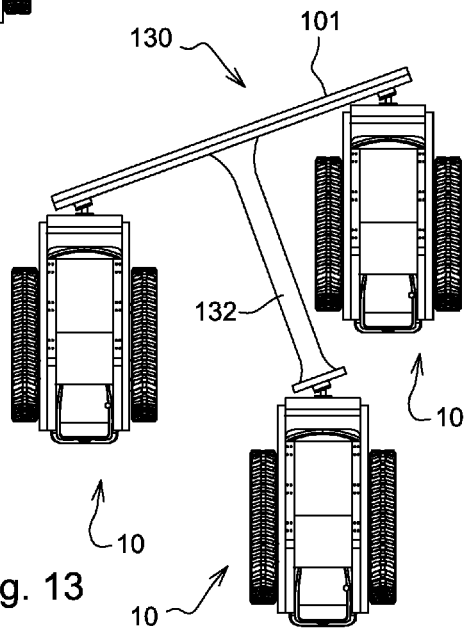
FIG. 13 is similar to FIG. 12, but showing the blade angled relative to the direction of travel.

FIG. 12 is a schematic top view of the blade arrangement 130 shown coupled to the adapters 76 carried by the boom arms 72 respectively carried by the right and left powered modules 10, and with a third powered module similarly connected to the rear bracket assembly 102, the three powered modules 10 being shown travelling in straight parallel paths, with the front modules being side-by-side and the blade 101 being shown disposed perpendicular to these paths. FIG. 13 is similar to FIG. 12, but here the right module 10 is shown ahead of the left module, with the blade being angled relative to the paths of travel of the three modules.

It is noted that a single operator can control operation of all three modules 10, as configured in FIGS. 12 and 13, with the operator preferably being located on the rearmost module 10 since the front two modules 10 can be easily observed from the rearmost module. An angle sensor (not shown) could be placed at the ball joint 104 at the connection of the rear bracket 102 with the central beam 132 for sensing the angle the beam 132 makes relative to a direction of travel of the rearmost module, this angle being the same as the angle the blade 101 makes to a line perpendicular to the direction of travel. The manned module 10 would be equipped with a computer and a display for displaying a desired orientation of the blade 101 relative to the direction of travel of the modules. Assuming the desired orientation of the blade 101 is that shown in FIG. 12, then an operator will look at the display and select a mode of operation wherein only the appropriate one of the forward modules 10 receives a driving signal for causing that module to move forward until the measured angle equals zero. Then an operation mode is selected for effecting simultaneous forward driving of all of the modules. If it is then desired to angle the blade 101 as shown in FIG. 13, the operator selects a mode of operation wherein only the right module 10 receives a driving signal with the rear module 10 being placed in a neutral condition and the left module braked, whereby the blade 101 is caused to rotate about its connection with the left module 10. When the display indicates that the blade 101 is in the position illustrated in FIG. 13, then a mode of operation is selected which results in each of the modules receiving the same driving signals. Signals may be transmitted by an appropriate wiring harness or by wireless means.

Figure 14:
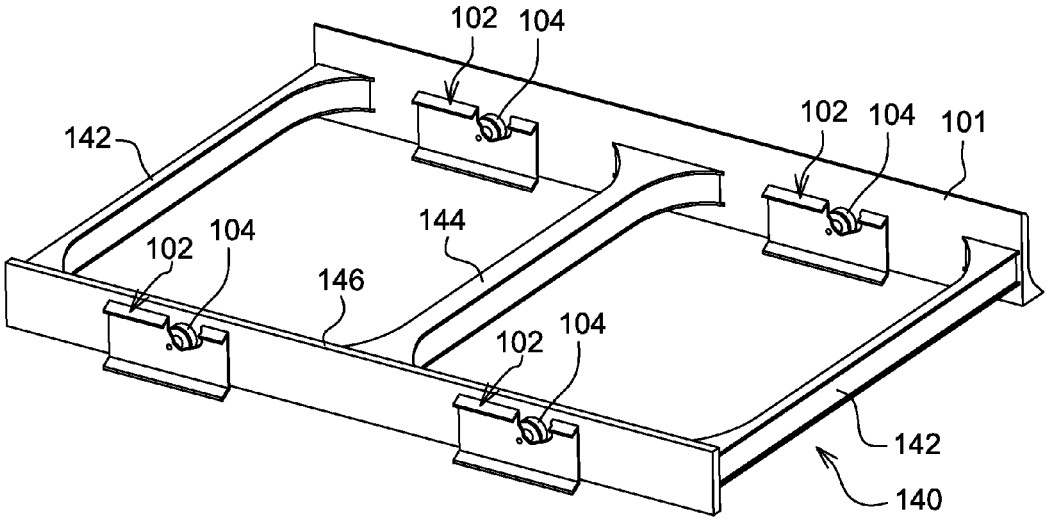
FIG. 14 is a right rear perspective view showing a fourth dozer blade embodiment to which first and second pairs of powered modules may be attached in fore-and-aft alignment with each other.

FIG. 14 shows a fourth dozer blade arrangement 140 wherein the blade 101 forms the forward end of a frame arrangement including right and left side beams 142 having their forward ends respectively joined to right and left backside locations adjacent opposite ends of the blade 101. A central beam 144 extends parallel to the side beams 142 and has its forward end fixed to the blade 101. Rear ends of the side beams 142 and central beam 144 are joined together by a cross beam 146. Mounted, through the agency of a first ball joint assembly 104, to the backside of the blade 101 at a central location between the left side beam 142 and the central beam 144 is a front left mounting bracket assembly 102, while a front right mounting bracket assembly 102 is similarly mounted to the backside of the blade 102 at a central location between the central beam 144 and the right side beam 142. Rear right and left mounting bracket assemblies 102 are respectively mounted to backside locations of the cross beam 146 which are respectively in fore-and-aft alignment with the front right and left mounting bracket assemblies 102.

It will be appreciated that four power modules 10, each equipped with boom arms 72, could be respectively connected to the four bracket assemblies 102 carried by the blade arrangement 140 and that blade pitch operations could be performed in the same manner described with reference to FIGS. 8-10, except here the front and rear pairs of modules 10 are respectively operated to perform the same as the single front and rear modules 10 shown in FIG. 7.

It is to be understood that the dozer blade arrangement 100 is only representative of a variety of earth working tools which would find utility in arrangements similar to those of the above-described dozer attachment. For example, other earth working tools such as scarifiers, rippers, box scrapers or the like, could be used instead of the dozer blade 101. Further, it is t be noted that, for some of the blade arrangements, the brackets 102 could be mounted to adapters 76 mounted directly to the front of the module frame 12. It is also to be noted that the universal connections 104 may not be needed for some dozer blade operations, such as fine grading, for example, but otherwise perform to provide desired flexibility when two or more of the modules are coupled to a given rigid frame, noting that frame sections could be interconnected by universal joints to achieve the desired flexibility.

Figure 15:
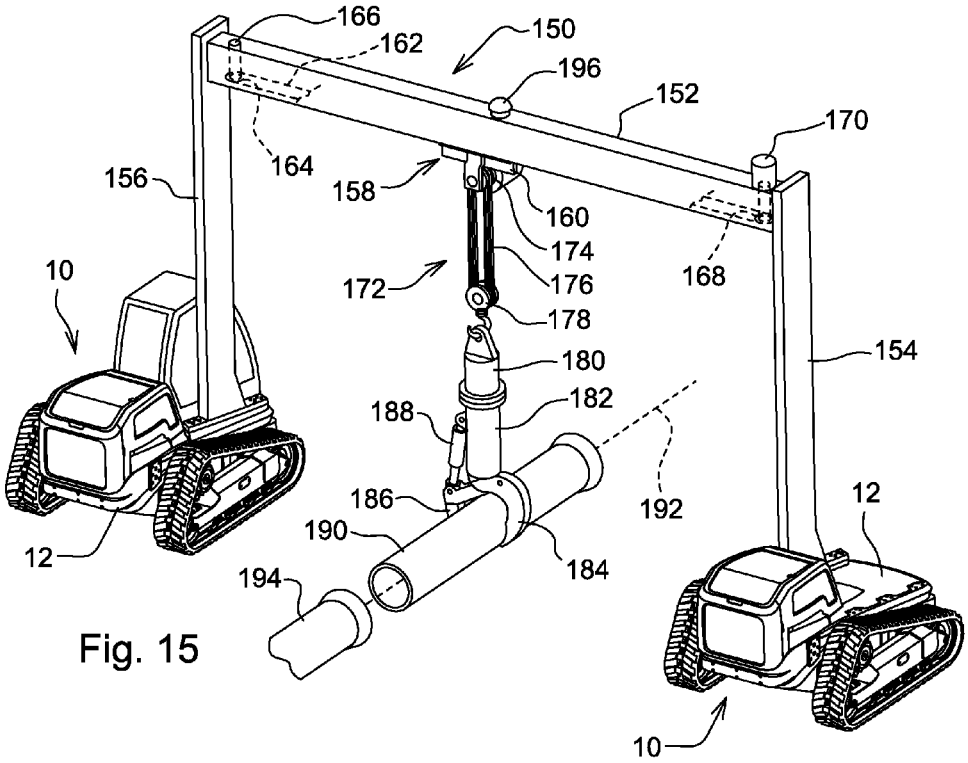
FIG. 15 is a schematic perspective view of a gantry crane showing opposite ends of the transverse beam of the crane respectively supported by a pair of powered mobile modules.

Referring now to FIG. 15, there is shown an attachment in the form of a gantry crane arrangement 150 including a frame arrangement defined by an elongate guide beam 152 having opposite ends to which are fixed top regions of vertical, right and left support posts 154 and 156. The guide beam 152 is disposed at right angles to longitudinal centerlines of right and left power modules 10 with a lower end region of the right support post 154 being fixed to a left, forward region of the main frame 12 of the right powered module 10, and with a lower end region of the left support post 156 being fixed to a right, forward region of the main frame 12 of the left powered module 10. The guide beam 152 is here shown as being a tube having a rectangular cross section, with the bottom side of the beam being provided with a guide slot (not shown) extending lengthwise of the beam. A carriage or trolley 158 includes a body (not shown) located within the beam 152 and joined to a top edge of a vertical plate 160 projecting downwardly from the body through the slot in the beam. Located within the beam 152 and projecting horizontally through and secured to the plate 160 are right and left axles, each having rollers mounted on their opposite ends such that pairs of rollers respectively on first and second ends of the axles engage the top surface of the bottom side of the beam 152 at opposite sides of the slot. Located within the beam 152 is a length of roller chain 162 looped about an idler sprocket 164 mounted for rotation about a vertical shaft 166 fixed within an upper side of the beam, and about a drive sprocket 168 fixed to a vertical drive shaft of a hydraulic motor 170 mounted to a top, right end region of the beam.

A hoist arrangement 172 includes a motor 174 pivotally suspended from the plate 160, with a length of an elongate, flexible hoist element 176, such as a cable or chain, forming a length-adjustable loop extending about a spool or pulley arrangement coupled for being driven by the motor, and a further spool or pulley arrangement associated with a supporting body 178. Pivotally suspended from the body 178 is an upper end of a motor housing 180 containing a hydraulic motor (not shown) having an output shaft disposed in axial alignment with, and coupled for effecting selective rotation of, a cylindrical support member 182. Mounted to the bottom of the support member 182 are right and left grapple arms 184 and 186, respectively, with the arm 184 being substantially semi-circular and having one end fixed across the bottom of the support member 182, and with the arm 186 being substantially L-shaped and having an end of its long leg pivotally attached to the grapple arm 184 at a location adjacent the support member 182. An extensible and retractable hydraulic actuator 188 is coupled between an upper region of the support member 182 and the grapple arm 186 at a location where the long and short legs of the L are joined.

The grapple arms 184 and 186 are here shown clamped onto a length of pipe 190 here being shown disposed in alignment with a centerline 192 of a previously placed length of pipe 194. A GPS receiver 196 is mounted on the center of the beam 152 and receives position information which can be used with other information for the precise orientation of the pipe 190. It is to be understood that the use of a grapple attachment with the crane arrangement is illustrative only and that other material handling attachments could be used.

Figure 16:
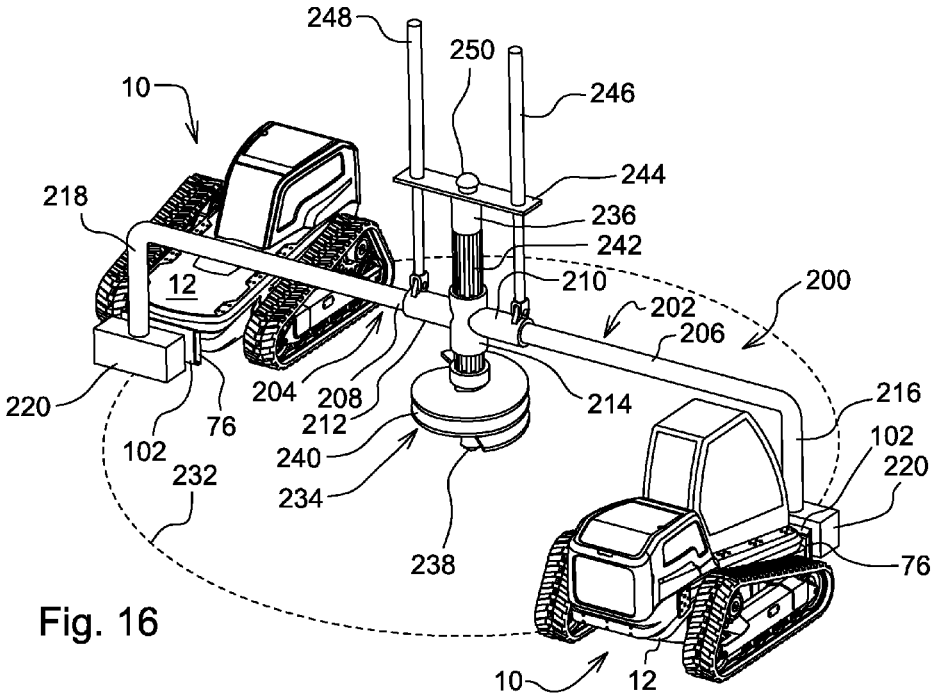
FIG. 16 is a schematic perspective view of a large vertical auger having oppositely extending arms respectively coupled to a pair of powered mobile modules traveling in opposite directions so as to rotate the auger.

Referring now to FIG. 16, there is shown an attachment in the form of a large auger arrangement 200 including a frame arrangement defined by a pair of tubular arms 202 and 204, respectively, having elongate axially aligned horizontal sections 206 and 208 including first ends respectively received within, and fixed to, horizontal cylindrical sleeves 210 and 212 projecting oppositely from, and being fixed to a vertical cylindrical stem guide 214 which is tubular and is provided with internal splines (not shown). Opposite second ends of the horizontal sections 206 and 208 of the arms 202 and 204 are respectively joined to relatively short vertical sections 216 and 218 each having a lower end secured to a mounting arrangement 220 including the mounting bracket assembly 102. First and second powered modules 10 are each equipped with a mounting adapter 76 at their forward ends which is secured to a respective mounting bracket assembly 102 forming a part of the mounting arrangement 220. If desired, the mounting adapter 76 could be carried at the forward end of a loader boom assembly 70 such as that shown in FIG. 4. In any event, the two powered modules 10 are oriented for traveling in opposite directions, with the directions shown here being along a circular path 232 when operating the auger arrangement for making a cylindrical hole in the ground, as described below in further detail.

An auger 234 includes an elongate central shaft or stem 236 having a bit 238 fixed to its lower end and helical flighting 240 secured to a lower end region of the stem. An upper end region of the stem 236 is provided with external splines 242 shaped complementary to, and being received for sliding within the internal splines of the stem guide 214. Fixed to the top of the stem 236 is a horizontal, cylinder mounting yoke 244, with a pair of vertically disposed, extensible and retractable hydraulic actuators 246 and 248 having rod ends respectively connected to the sleeves 210 and 212, and having cylinder barrels rigidly connected to opposite ends of the yoke 244. Thus, the auger 234 can be adjusted up and down by the actuators 246 and 248. Auxiliary hydraulic connections (not shown) are provided on the modules 10 with one set of the connections being coupled to the hydraulic actuators 246 and 248 by suitable hoses routed along one or the other of the frame arms 202 and 204.

Power for rotating the auger 234 is provided by the first and second powered modules 10, which are driven in opposite directions about the circular path 232, with clockwise rotation advancing the auger 234 into the ground and counterclockwise rotation retracting the auger from the ground. A GPS unit 250 is mounted to the top of the cylinder mounting yoke 204 so as to be vertically aligned with the auger stem 236. It is possible then to use the GPS unit 250 to provide a signal for allowing an operator of one of the powered module units 10 to position the auger for drilling a vertical hole at a desired location.

In operation, the module units 10 are driven using the output of the GPS unit 250 as a guide so as to place the auger 234 in vertical alignment with a location on the ground where a hole is desired. The auger 234 is then placed into ground contact by actuating the actuators 246 and 248 so as to extend the piston rods within the cylinders by pressurizing the top sides of the pistons. A pressure regulator (not shown) may be used to maintain a preselected down pressure on the auger 234 as the module units 10 are simultaneously driven along the circular path 232, thereby effecting rotation of the auger 234 in the clockwise direction. After forming the hole, the auger 234 may be raised out of the hole by pressurizing the bottom sides of the pistons of the actuators while exhausting fluid from the tops of the actuators. Further, it is noted that in installations where the arms 202 and 2044 are supported by boom arms 72, it is possible that the auger stem 236 can be constructed to accept an additional section or sections of stem located above the auger flighting 240 in order to be able to make deeper holes if desired, with the boom arms 72 being raised to accommodate the longer stem length and then placed in a float condition to permit the arms to lower as the auger is turned to make the hole deeper.

Having described the preferred embodiment, it will become apparent that 10 various modifications can be made without departing from the scope of the invention as defined in the accompanying claims.

The invention claimed is:

1. A mobile implement, comprising: at least first and second powered mobile modules each including a main support frame; rotatable ground supporting arrangements located at opposite sides of and connected in supporting relationship to said main support frame, and an engine supported by the main support frame for powering said module; an attachment including a frame arrangement including at least first and second spaced apart connection assemblies respectively connected to said first and second mobile modules; an earth working tool arrangement defining a forward portion of said frame arrangement; a central beam extending perpendicular to, and having a front end joined to the backside of said forward portion of said frame arrangement at a location centered between said first and second connection assemblies; opposite side beams extending parallel to said central beam and respectively having forward ends joined to respective opposite end locations of the backside of said forward portion of said frame arrangement; a rear cross beam extending perpendicular to and being fixed to respective rear ends of said central beam and opposite side beams, with said central and opposite side beams extending alongside said first and second mobile modules and with said rear cross beam extending behind, and being spaced from, said first and second mobile modules; third and fourth connection assemblies being mounted to a backside of said cross beam respectively in fore-and-aft alignment with said first and second connection assemblies; and third and fourth powered mobile modules having respective main support frames connected to said third and fourth connection assemblies.

2. The mobile implement, as defined in claim 1, wherein said earth working tool arrangement is a dozer blade defining said forward portion of said frame arrangement; and said opposite side beams having forward ends joined to opposite end locations of a backside of said blade.

3. The mobile implement, as defined in claim 2, wherein said first, second, third and fourth mobile powered modules are respectively equipped with first, second, third and fourth vertically swingable boom arm assemblies having respective rear end regions respectively mounted to the main support frames of the mobile modules and having front end regions respectively coupled to the first, second, third and fourth connection assemblies.

* * * * *